United States Patent [19]

Christophorou et al.

[11] Patent Number: 4,751,428

[45] Date of Patent: Jun. 14, 1988

[54] TERNARY GAS MIXTURE FOR DIFFUSE DISCHARGE SWITCH

[75] Inventors: Loucas G. Christophorou; Scott R. Hunter, both of Oak Ridge, Tenn.

[73] Assignee: The United States of America as represented by the United States Department of Energy, Washington, D.C.

[21] Appl. No.: 884,857

[22] Filed: Jul. 14, 1986

[51] Int. Cl.[4] ..... H01J 61/12; H05B 37/02

[52] U.S. Cl. ..... 313/637; 315/150

[58] Field of Search ..... 313/589, 637, 643; 315/150, 358; 372/86

[56] References Cited

U.S. PATENT DOCUMENTS 4,490,650 12/1984 Christophorou et al. ..... 315/150

OTHER PUBLICATIONS

Nakanishi et al; "Penning Ionization Ternary Gas Mixtures for Diffuse Discharge Switching Applications" Journal of Applied Physics, 7/15/1985, pp. 633–640.

*Primary Examiner*—David K. Moore
*Assistant Examiner*—Sandra L. O'Shea
*Attorney, Agent, or Firm*—Katherine P. Lovingood; Stephen D. Hamel; Judson R. Hightower

[57] ABSTRACT

A new diffuse discharge gas switch wherein a mixture of gases is used to take advantage of desirable properties of the respective gases. There is a conducting gas, an insulating gas, and a third gas that has low ionization energy resulting in a net increase in the number of electrons available to produce a current.

6 Claims, 2 Drawing Sheets

TERNARY GAS MIXTURE FOR DIFFUSE DISCHARGE SWITCH

This invention is an improved diffuse discharge switch to be used in pulse power technology that can accommodate substantially greater current than prior art switches thereby resulting in a more powerful pulse. It was developed pursuant to a contract with the U.S. Department of Energy.

BACKGROUND OF THE INVENTION

Among a number of switching devices, the diffuse gas discharge switch has proved to be a promising one for a system such as inductive energy storage in which repetitive and rapid switching is required. In particular, the use of an external electron beam or laser to sustain a volume gas discharge in the switch is advantageous because excessive heating of the electrodes and the gas can be avoided, and the discharge can return to its initial state of high resistivity very quickly once the source of ionization is removed.

The operation of a diffuse discharge switch used for inductive storage is characterized by two distinct stages. The first is a conducting or storing stage where the field in the switch is small. It is desirable in the conducting stage for the electron current density to be high by maximizing the electron drift velocity and simultaneously minimizing the average energy that is required to produce an electron-positive ion pair. When the electron drift velocity is maximized, more current is flowing through the switch and, therefore, more power is being stored in the inductor. When the energy required to produce an electron-positive ion pair is minimized, more electrons will be formed for a given amount of energy expended. Both these factors contribute to the free flow of electrons through the switch.

The second stage is the transferring stage when the stored energy in the inductor is transferred in a pulse to the load. During this stage, opposite characteristics of the gas within the switch are required than of the first stage. The dielectric strength must be large so that the gas can readily withstand the high induced voltage without breakdown. This can be done by the formation of negative ions by attachment of electrons to gas molecules.

The electron drift velocity is affected by the type of gas that is present in the switch. Since it is desirable to have a high electron drift velocity during the conducting stage and a low electron drift velocity during the opening stage, the gas in the switch must be able to perform two opposite functions. To achieve this, gas mixtures have been developed that have both good electron conducting properties and electron attaching or insulating properties so that the benefits of each during the respective stages can be realized. Previous development of such gas mixtures by the applicants is set forth in U.S. Pat. No. 4,490,650 issued Dec. 25, 1984. Although the gas mixtures previously developed can carry a significant amount of energy in order to achieve a strong pulse with great power, it is necessary to extend the capability of the switch to carry more current with a resulting increase in the amount of the energy that can be stored in the inductor. Existing gas mixtures have limits on their conducting capabilities when the switch is closed; therefore, there is a need to develop a gas for the diffused discharge gas switch that allows high current flow but has sufficient insulating capabilities to withstand an increase in the voltage when the current source is discontinued.

SUMMARY OF THE INVENTION

In view of the above-mentioned need, it is an object of this invention to provide a switching device for an inductive energy storage system that can accommodate extremely high currents.

Another object of the invention is to provide a switch with improved efficiency capable of conducting a high electron current density for a given amount of expended energy.

Another object of the invention is to provide a gas mixture for a diffused gas discharge switch that has suitable conducting and insulating properties.

Other objects and advantages of the invention will become apparent to those skilled in the art upon study of the specifications and the appended claims.

To achieve these objects, the invention is a switching device comprised of a diffuse discharge switch which contains a ternary gas mixture. The first gas is one that does not ionize readily, the second gas has good electron attaching properties at high electron energies, and a third gas has a low ionization potential. The gases are present in sufficient proportions to cause a net increase in the number of electrons in the conducting stage without significantly changing the electron drift velocity during conduction and the insulating properties of the switching mechanism during the switch opening.

The invention is also a ternary gas mixture to be used in a diffuse discharge gas switch having the properties of both good conductance when the switch is closed and good insulation when the switch is opened.

The preferred gases of the ternary mixture are argon, xenon, krypton, or methane as the buffered gas; $CF_4$, $C_2F_6$, $C_3F_8$, n-$C_4F_{10}$, or $(CF_3)_2O$ as the electron attaching gas; and $C_2H_2$ or 2-$C_4H_8$ or other molecular gases having low ionization potentials.

DETAILED DESCRIPTION OF THE PREFERRED EMBODIMENT

In the previous development by the inventors of the diffuse discharge gas switch described in U.S. Pat. No. 4,490,650, there was a binary mixture of buffer and insulating gases to perform the necessary function of conducting and insulating a current. The current conducted was initially produced by a high energy electron beam source which bombarded the binary gas mixture in the switch and resulted in ionization of the gases producing electrons and positive ion pairs. There were three sources of electrons in the switch: the electron beam source, electrons from the buffer gas (argon), and electrons from the insulating gas (a fluoroalkane). The subject invention provides a method whereby the number of electrons present in the switch is increased significantly thereby increasing the current to a proportionate degree.

In the previously developed binary gas switch, bombardment of the gas with a high energy electron source not only releases electrons from some gas atoms or molecules to electron-positive ion pairs, but also elevates other gas atoms to higher energy states when electrons are excited to higher electron shells but not fully released. Excited electrons continuously return to the ground state and emit photons which may be resonantly reabsorbed by other gas atoms; therefore, the gas is in a constant state of absorbing and emitting photons when the switch is closed. The energy in the system incidental to this continuous photon emission does not contribute to the efficiency of the system and is wasted. It was the intention of the inventors to develop a method to increase the number of electrons in the switching system to provide a stronger current and more powerful pulse by utilizing this wasted energy. It was theorized that a third gas having a low ionization potential might be ionized not only by the bombardment by electrons, but also by collision with excited gas atoms. When tested, the theory proved to be correct.

Figure 1:
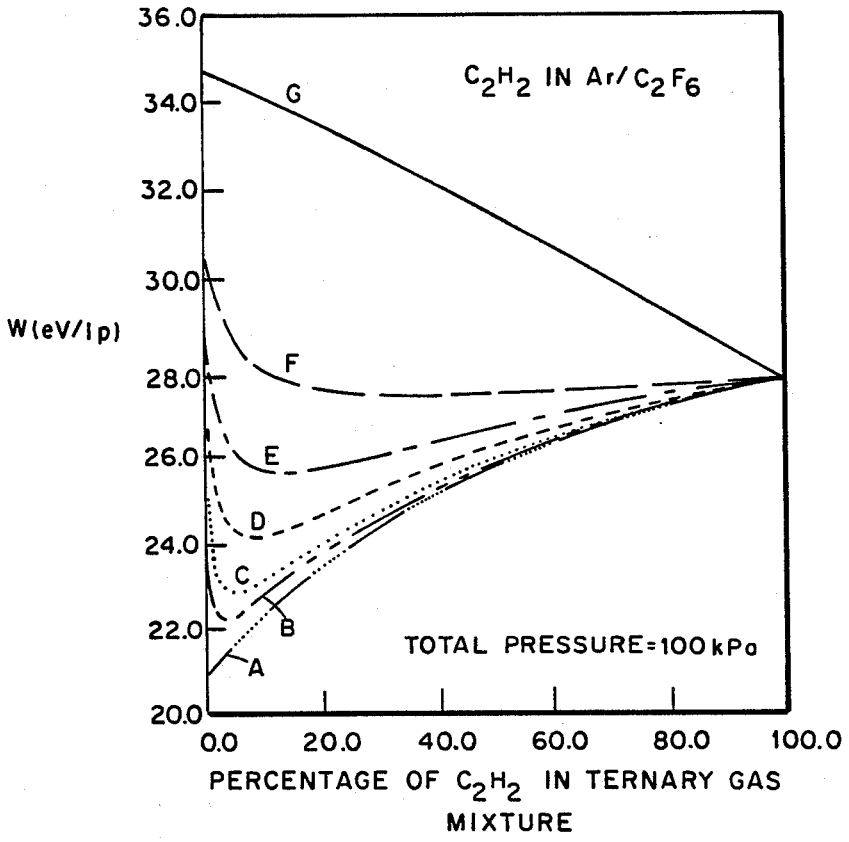
FIG. 1. Experimental W values (average energy required to produce an electron-positive ion pair) of $Ar/C_2F_6/C_2H_2$ ternary gas mixtures as a function of percentage of $C_2H_2$ in $Ar/C_2F_6$ mixtures where $Ar/C_2F_6$ is present in the following concentrations: A=1/0, B=99/1, C=49/1, D=19/1, E=9/1, F=4/1, G=0/1.
Figure 2:
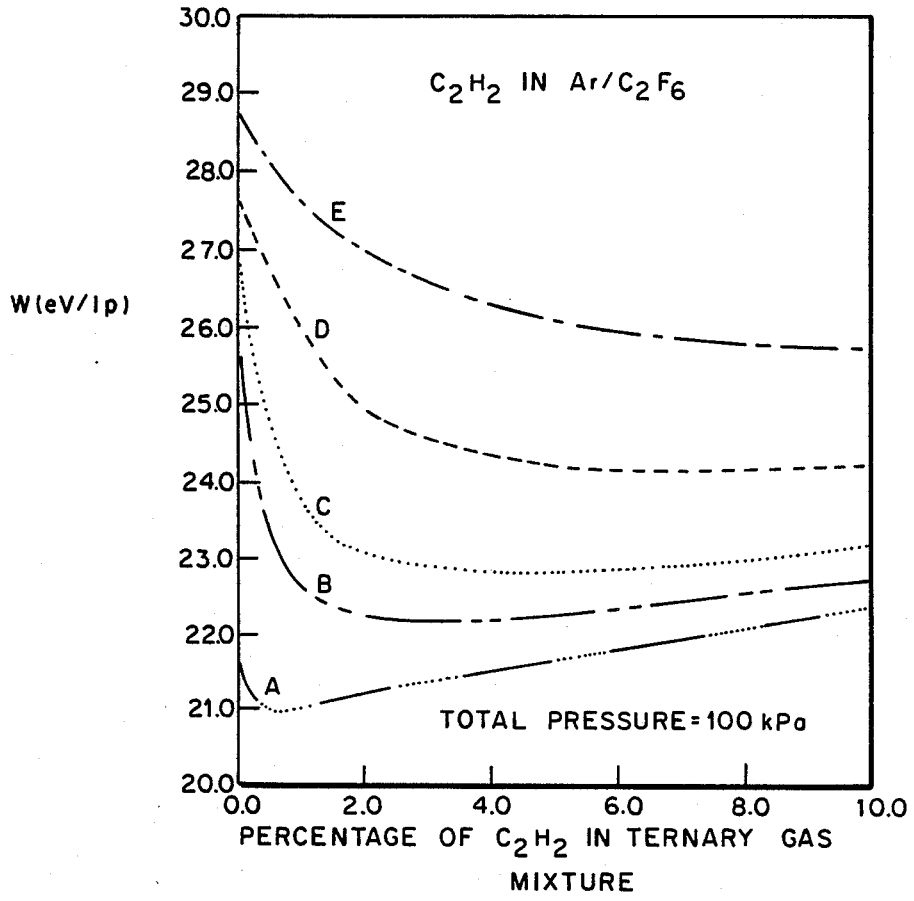
FIG. 2. Experimental W values of $Ar/C_2F_6/C_2H_2$ ternary gas mixtures as a function of the percentage of $C_2H_2$ in $Ar/C_2F_6$ at low concentrations.

A simulated switch was prepared to test the theory of the applicants using the gases argon, $C_2F_6$ and $C_2H_2$ and several other gas mixtures. Measurements were taken to determine the energy that was required to produce an electron and a positive ion pair (W). FIG. 1 shows the energy as it relates to the concentration of the $C_2H_2$ in the ternary gas mixture. The less energy that is required to produce an electron and positive ion pair, the more electrons there will be formed and the higher will be the current. The curves of FIG. 1 represent the calculated values of W extrapolated from experimental results for the following ratios of binary gas mixtures of $Ar/C_2F_6$: A=1/0, B=99/1, C=49/1, D=19/1, E=9/1, F=4/1 and G=0/1 to which the third gas is added at various concentrations. Since the benefit of additions of $C_2H_2$ is more at lower concentrations, FIG. 2 is an enlarged graphic representation of the mixtures A through E containing from 0 to 10% $C_2H_2$. W values are lowest when $C_2H_2$ is present from ½ to 2% when Ar concentrations are high (A, B, and C) and up to 6% when $C_2F_6$ concentrations are increased to 10% of the $Ar/C_2F_6$ mixture (D and E). The precise concentration desired can be determined by a person of ordinary skill in the art.

The amounts of the third gas needed to increase the electron density significantly are extremely small and have litle or no effect on the electron drift velocity or the insulating properties of the gas. If increased insulation is desired, it can easily be obtained by increasing the distance between the electrodes or the gas pressure.

The result of this ternary mixture being substituted in the switch for the prior binary mixture is a two- to three-fold increase in the current flow through the switch, thereby increasing the efficiency of the energy storage in the inductive energy storage element by a similar amount. This improvement allows higher amounts of electrical energy to be delivered to the load with the same source conditions. In addition, the increased efficiency in ionization of the gas results in less heat being released within the switch. This gas mixture constitutes a significant improvement in the efficiency of diffuse discharge switches needed in pulse power technology.

We claim:

1. A gas mixture comprising:

a conducting gas that does not readily attach electrons;

an insulating gas that readily attaches higher energy electrons; and a third gas having an ionization potential sufficiently low that it can release electrons upon collision with atoms of said conducting or insulating gas when in an excited electronic state;

wherein said gases are present in suitable proportions to maximize current and maintain sufficient insulation properties to protect said switch from voltage damage.

2. The gas mixture of claim 1 wherein said conducting gas is selected from the group argon, xenon, kryton, or $CH_4$;

said insulating gas is selected from the group $CF_4$, $C_2F_6$, $C_3F_8$, n-$C_4F_{10}$, or $(CF_3)_2O$;

and said third gas is selected from the group $C_2H_2$ or 2-$C_4H_8$.

3. The gas mixture of claim 2 wherein said conducting gas is argon and said insulating gas is $C_2F_6$ and they are present in a range of proportions from 99/1 to 90/10, respectively, and said third gas is $C_2H_2$ and constitutes from ½ to 6% of said gas mixture.

4. A diffuse discharge gas switch comprising: a diffuse discharge gas switch having contained within a gas mixture comprising:

a conducting gas that does not readily attach electrons;

an insulating gas that readily attaches higher energy electrons; and a third gas having an ionization potential sufficiently low that it can release electrons upon collison with atoms of said conducting or insulating gas when in an excited electronic state;

wherein said gases are present in suitable proportions to maximize current and maintain sufficient insulation properties to protect said switch from voltage damage.

5. The diffuse discharge gas switch of claim 4 wherein said conducting gas is selected from the group argon, xenon, kryton, or $CH_4$;

said insulating gas is selected from the group $CF_4$, $C_2F_6$, $C_3F_8$, n-$C_4F_{10}$, or $(CF_3)_2O$;

and said third gas is selected from the group $C_2H_2$ or 2-$C_4H_8$.

6. The diffuse discharge gas switch of claim 5 wherein said conducting is argon and said insulating gas is $C_2F_6$ and they are present in a range of proportions from 99/1 to 90/10, respectively, and said third gas is $C_2H_2$ and constitutes from ½ to 6% of said gas mixture.

* * * * *